US009989051B2

(12) United States Patent
Noh et al.

(10) Patent No.: US 9,989,051 B2
(45) Date of Patent: Jun. 5, 2018

(54) LINEAR COMPRESSOR

(71) Applicant: LG ELECTRONICS INC., Seoul (KR)

(72) Inventors: Kiwon Noh, Seoul (KR); Kyungmin Lee, Seoul (KR); Jeehyun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 290 days.

(21) Appl. No.: 14/804,640

(22) Filed: Jul. 21, 2015

(65) Prior Publication Data

US 2016/0017875 A1 Jan. 21, 2016

(30) Foreign Application Priority Data

Jul. 21, 2014 (KR) ..... 10-2014-0091879

(51) Int. Cl.
*F04B 39/00* (2006.01)
*F04B 53/10* (2006.01)
(Continued)

(52) U.S. Cl.
CPC ..... *F04B 53/1035* (2013.01); *F04B 39/08* (2013.01); *F04B 39/102* (2013.01);
(Continued)

(58) Field of Classification Search
CPC .. F04B 35/045; F04B 39/102; F04B 39/1033; F04B 53/1022; F04B 53/1032;
(Continued)

(56) References Cited

U.S. PATENT DOCUMENTS 1,852,033 A 4/1932 Summers
1,892,711 A 1/1933 Summers
(Continued)

FOREIGN PATENT DOCUMENTS

CN 1334405 2/2002
CN 1757916 4/2006
(Continued)

OTHER PUBLICATIONS

Chinese Office Action dated Jan. 23, 2017.
(Continued)

*Primary Examiner* — Devon Kramer
*Assistant Examiner* — Christopher Bobish
(74) *Attorney, Agent, or Firm* — KED & Associates LLP

(57) ABSTRACT

A linear compressor is provided that may include a shell in which a discharge port may be provided, a cylinder disposed in the shell to define a compression space for a refrigerant, a piston disposed to be reciprocated in an axial direction within the cylinder, a discharge valve disposed on or at one side of the cylinder to selectively discharge the refrigerant compressed in the compression space, a valve spring coupled to the discharge valve to provide a restoring force, and a stopper coupled to the valve spring to restrict deformation of the valve spring. The stopper may include a guide recessed in a direction in which the valve spring is deformed to reduce an impulse between the stopper and the valve spring.

9 Claims, 15 Drawing Sheets

(51) Int. Cl.

| | |
|---|---|
| ***F04B 39/08*** | (2006.01) |
| ***F04B 39/10*** | (2006.01) |
| *F04B 39/12* | (2006.01) |
| *F04B 35/04* | (2006.01) |

(52) U.S. Cl.
CPC ..... *F04B 39/1033* (2013.01); *F04B 53/1022* (2013.01); *F04B 53/1032* (2013.01); *F04B 35/045* (2013.01); *F04B 39/121* (2013.01); *Y10T 137/7922* (2015.04); *Y10T 137/7934* (2015.04); *Y10T 137/7936* (2015.04)

(58) Field of Classification Search
CPC ..... F04B 53/1035; Y10T 137/7922; Y10T 137/7936; Y10T 137/7934; Y10T 137/7932
USPC ..... 417/417, 569, 570, 902; 137/543.17, 137/543.13
See application file for complete search history.

(56) References Cited

U.S. PATENT DOCUMENTS

| | | | | | |
|---|---|---|---|---|---|
| 3,039,487 | A * | 6/1962 | Doeg | F04B 39/102 | 137/516.11 |
| 3,077,899 | A * | 2/1963 | Waibel | F04B 39/10 | 137/512 |
| 3,878,861 | A | 4/1975 | Pareja | | |
| 4,385,872 | A * | 5/1983 | Anderson | F04B 39/10 | 417/566 |
| 4,450,860 | A * | 5/1984 | Francis | F04B 39/108 | 137/543.19 |
| 4,964,423 | A * | 10/1990 | Gausman | F16K 15/02 | 137/543.17 |
| 4,981,421 | A * | 1/1991 | Baumann | F04B 39/102 | 137/888 |
| 5,203,857 | A * | 4/1993 | Terwilliger | F04B 39/102 | 137/533.29 |
| 5,232,354 | A * | 8/1993 | Clement | F04B 39/102 | 137/516.23 |
| 5,346,373 | A | 9/1994 | Riffe | | |
| 5,584,676 | A * | 12/1996 | Dreiman | F04B 39/102 | 137/533.27 |
| 5,664,602 | A * | 9/1997 | Madrid | F16K 15/026 | 137/515.7 |
| 7,275,561 | B2 | 10/2007 | Kim et al. | | |
| 7,762,793 | B2 * | 7/2010 | Gray | A61M 5/14216 | 310/14 |
| 8,057,200 | B2 * | 11/2011 | Kang | F04B 35/045 | 181/274 |
| 2005/0092374 | A1 | 5/2005 | Kim et al. | | |
| 2006/0076014 | A1 | 4/2006 | Jung et al. | | |
| 2010/0024891 | A1 * | 2/2010 | Francini | F16K 15/026 | 137/14 |
| 2010/0266429 | A1 * | 10/2010 | Kang | F04B 39/0088 | 417/417 |
| 2016/0017876 | A1 * | 1/2016 | Kim | F04B 39/102 | 417/443 |
| 2016/0017883 | A1 * | 1/2016 | Noh | F04B 35/045 | 417/437 |

FOREIGN PATENT DOCUMENTS

| | | |
|---|---|---|
| CN | 201502501 | 6/2010 |
| CN | 101835978 | 9/2010 |
| CN | 202991397 | 6/2013 |
| CN | 104220752 | 12/2014 |
| DE | 7513261 | 10/1976 |
| KR | 10-1307688 | 9/2013 |
| WO | WO 2008/079961 | 7/2008 |
| WO | WO 2013/071382 | 5/2013 |

OTHER PUBLICATIONS

Chinese Office Action dated Feb. 14, 2017 (English Translation).
U.S. Office Action dated Jun. 5, 2017 issued in U.S. Appl. No. 14/804,425.
European Search Report dated Dec. 4, 2015.
U.S. Appl. No. 14/804,425, filed Jul. 21, 2015.
Chinese Office Action dated Jul. 12, 2017.

* cited by examiner

LINEAR COMPRESSOR

CROSS-REFERENCE TO RELATED APPLICATION(S)

The present application claims priority under 35 U.S.C. 119 and 35 U.S.C. 365 to Korean Patent Application No. 10-2014-0091879, filed in Korea on Jul. 21, 2014, which is hereby incorporated by reference in its entirety.

BACKGROUND

1. Field

A linear compressor is disclosed herein.

2. Background

Cooling systems are systems in which a refrigerant is circulated to generate cool air. In such a cooling system, processes of compressing, condensing, expanding, and evaporating the refrigerant may be repeatedly performed. For this, the cooling system may include a compressor, a condenser, an expansion device, and an evaporator. Also, the cooling system may be installed in a refrigerator or air conditioner, which is a home appliance.

In general, compressors are machines that receive power from a power generation device, such as an electric motor or turbine, to compress air, a refrigerant, or various working gases, thereby increasing in pressure. Compressors are being widely used in home appliances or industrial fields.

Compressors may be largely classified into reciprocating compressors, in which a compression space, into and from which a working gas, such as a refrigerant, may be suctioned and discharged, is defined between a piston and a cylinder to allow the piston to be linearly reciprocated in the cylinder, thereby compressing the working gas; rotary compressors, in which a compression space into and from which a working gas, such as a refrigerant, may be suctioned and discharged, is defined between a roller that eccentrically rotates and a cylinder to allow the roller to eccentrically rotate along an inner wall of the cylinder, thereby compressing the working gas; and scroll compressors, in which a compression space into and from which a working gas, such as a refrigerant, may be suctioned and discharged, is defined between an orbiting scroll and a fixed scroll to compress the working gas while the orbiting scroll rotates along the fixed scroll. In recent years, a linear compressor, which is directly connected to a drive motor, and in which a piston is linearly reciprocated, to improve compression efficiency without mechanical loss due to movement conversion and having a simple structure, is being widely developed.

The linear compressor may suction and compress a refrigerant while a piston is linearly reciprocated in a sealed shell by a linear motor, and then, discharge the refrigerant. The linear motor may be configured to allow a permanent magnet to be disposed between an inner stator and an outer stator. The permanent magnet may be linearly reciprocated by an electromagnetic force between the permanent magnet and the inner (or outer) stator. Also, as the permanent magnet operates in a state in which the permanent magnet is connected to the piston, the permanent magnet may suction and compress the refrigerant while being linearly reciprocated within the cylinder and then discharge the refrigerant.

The present Applicant filed for a patent (hereinafter, referred to as a "prior document") and registered the patent with respect to a linear compressor, as Korean Patent No. 10-1307688, filed in Korea on Sep. 5, 2013, and entitled "linear compressor", which is hereby incorporated by reference. The linear compressor according to the prior document includes a shell that accommodates a plurality of components. A vertical height of the shell may be somewhat high, as illustrated in FIG. 2 of the prior document. Also, an oil supply assembly to supply oil between a cylinder and a piston may be disposed within the shell.

When the linear compressor is provided in a refrigerator, the linear compressor may be disposed in a machine chamber, which may be provided at a rear side of the refrigerator. In recent years, a major concern of customers is increasing an inner storage space of the refrigerator. To increase the inner storage space of the refrigerator, it may be necessary to reduce a volume of the machine room. Also, to reduce the volume of the machine room, it may be important to reduce a size of the linear compressor. However, as the linear compressor disclosed in the prior document has a relatively large volume, the linear compressor is not suitable for a refrigerator for which an increase in the inner storage space is desired or sought.

Further, to reduce the size of the linear compressor, it may be necessary to reduce a size of a main component of the linear compressor. In this case, a surface of the linear compressor may deteriorate. To compensate for the deteriorated performance of the linear compressor, it may be necessary to increase a drive frequency of the compressor. However, the more the drive frequency of the linear compressor is increased, the more a friction force due to oil circulating in the linear compressor increases, deteriorating performance of the linear compressor.

The prior document discloses a feature in which a discharge valve spring that supports a discharge valve is provided as a coil spring. When the coil spring is applied to the discharge valve spring, the discharge valve may rotate with respect to the coil spring, causing abrasion of the discharge valve.

BRIEF DESCRIPTION OF THE DRAWINGS

Embodiments will be described in detail with reference to the following drawings in which like reference numerals refer to like elements, and wherein.

DETAILED DESCRIPTION

Hereinafter, exemplary embodiments will be described with reference to the accompanying drawings. The embodiments may, however, be embodied in many different forms and should not be construed as being limited to the embodiments set forth herein; rather, alternate embodiments included in other retrogressive inventions or falling within the spirit and scope will fully convey the concept to those skilled in the art.

Figure 1:
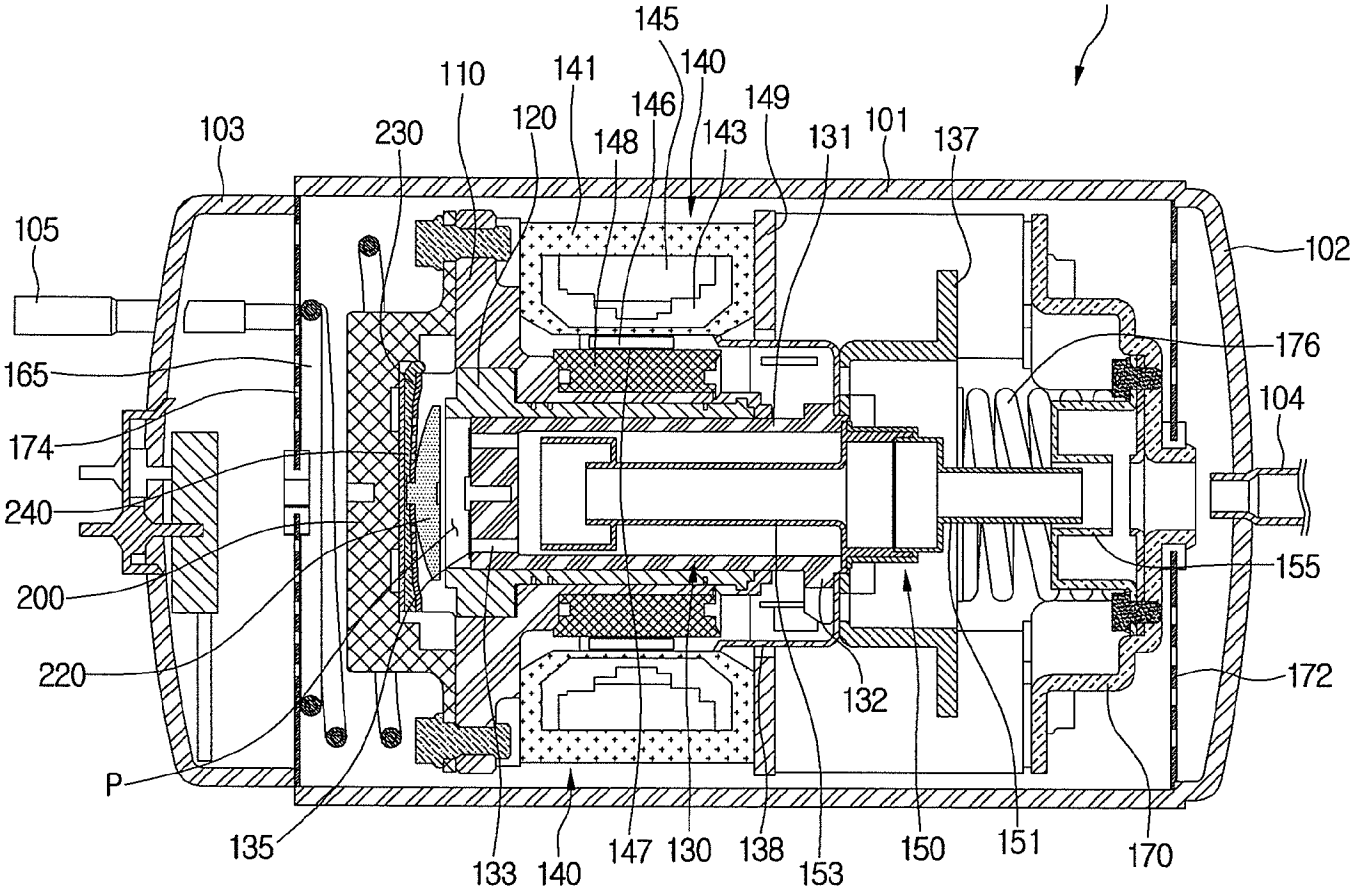
FIG. 1 is a cross-sectional view of a linear compressor according to an embodiment.

FIG. 1 is a cross-sectional view of a linear compressor according to an embodiment. Referring to FIG. 1, the linear compressor 100 according to an embodiment may include a shell 101 having an approximately cylindrical shape, a first cover 102 coupled to one or a first side of the shell 101, and a second cover 103 coupled to the other or a second side of the shell 101. For example, the linear compressor 100 may be laid out in a horizontal direction. Also, in the linear compressor 100, the first cover 102 may be coupled to a right side of the shell 101, and the second cover 103 may be coupled to a left side of the shell 101. Each of the first and second covers 102 and 103 may be understood as one component of the shell 101.

The linear compressor 100 may include a cylinder 120 provided in the shell 101, a piston 130 linearly reciprocated within the cylinder 120, and a motor 140 that serves as a linear motor that applies a drive force to the piston 130. When the motor 140 operates, the piston 130 may be linearly reciprocated at a high rate. The linear compressor 100 according to this embodiment may have a drive frequency of about 100 Hz, for example.

The linear compressor 100 may include a suction port 104, through which a refrigerant may be introduced, and a discharge port 105, through which the refrigerant compressed in the cylinder 120 may be discharged. The suction port 104 may be coupled to the first cover 102, and the discharge port 105 may be coupled to the second cover 103.

The refrigerant suctioned in through the suction port 104 may flow into the piston 130 via the suction muffler 150. Thus, while the refrigerant passes through the suction muffler 150, noise may be reduced. The suction muffler 150 may include a first muffler 151 coupled to a second muffler 153. At least a portion of the suction muffler 150 may be disposed within the piston 130.

The piston 130 may include a piston body 131 having an approximately cylindrical shape, and a piston flange 132 that extends from the piston body 131 in a radial direction. The piston body 131 may be reciprocated within the cylinder 120, and the piston flange 132 may be reciprocated outside of the cylinder 120.

The piston 130 may be formed of an aluminum material, such as aluminum or an aluminum alloy, which is a nonmagnetic material. As the piston 130 may be formed of the aluminum material, a magnetic flux generated in the motor 140 may be transmitted into the piston 130, preventing the magnetic flux from leaking outside of the piston 130. Also, the piston 130 may be manufactured by a forging process, for example.

The cylinder 120 may be formed of an aluminum material, such as aluminum or an aluminum alloy, which is a nonmagnetic material. Also, the cylinder 120 and the piston 130 may have a same material composition, that is, a same kind and composition.

As the cylinder 120 may be formed of the aluminum material, a magnetic flux generated in the motor 140 may be transmitted into the cylinder 120 to prevent the magnetic flux from leaking outside of the cylinder 120. Also, the cylinder 120 may be manufactured by an extruding rod processing process, for example.

Also, as the piston 130 may be formed of a same material (aluminum) as the cylinder 120, the piston 130 may have a same thermal expansion coefficient as the cylinder 120. When the linear compressor 100 operates, a high-temperature (a temperature of about 100℃) environment may be created within the shell 100. Thus, as the piston 130 and the cylinder 120 have the same thermal expansion coefficient, the piston 130 and the cylinder 120 may be thermally deformed by a same degree. As a result, the piston 130 and the cylinder 120 may be thermally deformed with sizes and in directions different from each other to prevent the piston 130 from interfering with the cylinder 120 while the piston 130 moves.

The cylinder 120 may be configured to accommodate at least a portion of the suction muffler 150 and at least a portion of the piston 130. The cylinder 120 may have a compression space P, in which the refrigerant may be compressed by the piston 130. A suction hole 133, through which the refrigerant may be introduced into the compression space P, may be defined in or at a front portion of the piston 130, and a suction valve 135 to selectively open the suction hole 133 may be disposed on a front side of the suction hole 133. A coupling hole, to which a predetermined coupling member may be coupled, may be defined in or at an approximately central portion of the suction valve 135.

A discharge cover 200 that defines a discharge space or discharge passage for the refrigerant discharged from the compression space P, and a discharge valve assembly 220, 230, 240 coupled to the discharge cover 200 to selectively discharge the refrigerant compressed in the compression space P may be provided at a front side of the compression space P. The discharge valve assembly 220, 230, 240 may include a discharge valve 220 to introduce the refrigerant into the discharge space of the discharge cover 200 when a pressure within the compression space P is above a discharge pressure, a valve spring 230 disposed between the discharge valve 220 and the discharge cover 200 to apply an elastic force in an axial direction, and a stopper 240 that restricts deformation of the valve spring 230.

The term "compression space P" may refer to a space defined between the suction valve 135 and the discharge valve 230. Also, the suction valve 135 may be disposed on or at one or a first side of the compression space P, and the discharge valve 220 maybe disposed on the other or a second side of the compression space P, that is, a side opposite of the suction valve 135.

A term "axial direction" may refer to a direction in which the piston 130 is reciprocated, that is, a transverse direction in FIG. 1. Also, in the axial direction, a direction from the suction port 104 toward the discharge port 105, that is, a direction in which the refrigerant flows, may be defined as a "frontward direction", and a direction opposite to the frontward direction may be defined as a "rearward direction". On the other hand, the term "radial direction" may refer to a direction that is substantially perpendicular to the direction in which the piston 130 is reciprocated, that is, a horizontal direction in FIG. 1.

The stopper 240 may be seated on the discharge cover 200, and the valve spring 230 may be seated at a rear side of the stopper 240. The discharge valve 220 may be coupled to the valve spring 230, and a rear portion or rear surface of the discharge valve 220 may be supported by a front surface of the cylinder 120. For example, the valve spring 230 may include a plate spring.

While the piston 130 is linearly reciprocated within the cylinder 120, when the pressure of the compression space P is below the discharge pressure and a suction pressure, the suction valve 135 may be opened to suction the refrigerant into the compression space P. On the other hand, when the pressure of the compression space P is above the suction pressure, the refrigerant may be compressed in the compression space P in a state in which the suction valve 135 is closed.

When the pressure of the compression space P is above the discharge pressure, the valve spring 230 may be deformed to open the discharge valve 220. The refrigerant may be discharged from the compression space P into the discharge space of the discharge cover 200. When the discharge of the refrigerant is completed, the valve spring 230 may provide a restoring force to the discharge valve 220 to close the discharge valve 220.

Also, the refrigerant flowing into the discharge space of the discharge cover 200 may be introduced into a loop pipe 165. The loop pipe 165 may be coupled to the discharge cover 200 to extend to the discharge port 105, thereby guiding the compressed refrigerant of the discharge space into the discharge port 105. For example, the loop pipe 165 may have a shape that is wound in a predetermined direction and extends in a rounded shape. Also, the loop pipe 165 may be coupled to the discharge port 105.

The linear compressor 100 may further include a frame 110. The frame 110 may fix the cylinder 120 and be coupled to the cylinder 120 by a separate coupling member, for example. The frame 110 may be disposed to surround the cylinder 120. That is, the cylinder 120 may be accommodated within the frame 110. Also, the discharge cover 200 may be coupled to a front surface of the frame 110.

At least a portion of the high-pressure gas refrigerant discharged through the opened discharge valve 220 may flow toward an outer circumferential surface of the cylinder 120 through a space at a portion at which the cylinder 120 and the frame 110 are coupled to each other. The refrigerant may be introduced into the cylinder 120 through a gas inflow (see reference numeral 122 of FIG. 7) and a nozzle (see reference numeral 123 of FIG. 7), which may be defined in the cylinder 120. The introduced refrigerant may flow into a space defined between the piston 130 and the cylinder 120 to allow an outer circumferential surface of the piston 130 to be spaced apart from an inner circumferential surface of the cylinder 120. Thus, the introduced refrigerant may serve as a "gas bearing" that reduces friction between the piston 130 and the cylinder 120 while the piston 130 is reciprocated. That is, in this embodiment, a bearing using oil is not applied.

The motor 140 may include outer stators 141, 143, and 145 fixed to the frame 110 and disposed to surround the cylinder 120, an inner stator 148 disposed to be spaced inward from the outer stators 141, 143, and 145, and a permanent magnet 146 disposed in a space between the outer stators 141, 143, and 145 and the inner stator 148. The permanent magnet 146 may be linearly reciprocated by a mutual electromagnetic force between the outer stators 141, 143, and 145 and the inner stator 148. Also, the permanent magnet 146 may be provided as a single magnet having one polarity, or a plurality of magnets having three polarities.

The permanent magnet 146 may be coupled to the piston 130 by a connection member 138, for example. In detail, the connection member 138 may be coupled to the piston flange 132 and be bent to extend toward the permanent magnet 146. As the permanent magnet 146 is reciprocated, the piston 130 may be reciprocated together with the permanent magnet 146 in the axial direction.

The motor 140 may further include a fix member 147 to fix the permanent magnet 146 to the connection member 138. The fixing member 147 may be formed of a composition, in which a glass fiber or carbon fiber may be mixed with a resin. The fixing member 147 may be provided to surround an outside of the permanent magnet 146 to firmly maintain a coupled state between the permanent magnet 146 and the connection member 138.

The outer stators 141, 143, and 145 may include coil winding bodies 143 and 145, and a stator core 141. The coil winding bodies 143 and 145 may include a bobbin 143, and a coil 145 wound in a circumferential direction of the bobbin 145. The coil 145 may have a polygonal cross-section, for example, a hexagonal cross-section. The stator core 141 may be manufactured by stacking a plurality of laminations in the circumferential direction and be disposed to surround the coil winding bodies 143 and 145, for example.

A stator cover 149 may be disposed on or at one side of the outer stators 141, 143, and 145. One or a first side of the outer stators 141, 143, and 145 may be supported by the frame 110, and the other or second side of the outer stators 141, 143, and 145 may be supported by the stator cover 149. The inner stator 148 may be fixed to a circumference of the frame 110. Also, in the inner stator 148, the plurality of laminations may be stacked in the circumferential direction outside of the frame 110.

The linear compressor 100 may further include a support 137 that supports the piston 130, and a back cover 170 spring-coupled to the support 137. The support 137 may be coupled to the piston flange 132 and the connection member 138 by a predetermined coupling member, for example.

A suction guide 155 may be coupled to a front portion of the back cover 170. The suction guide 155 may guide the refrigerant suctioned through the suction port 104 to introduce the refrigerant into the suction muffler 150.

The linear compressor 100 may include a plurality of springs 176 which may be adjustable in natural frequency to allow the piston 130 to perform a resonant motion. The plurality of springs 176 may include a first spring supported between the support 137 and the stator cover 149, and a second spring supported between the support 137 and the back cover 170.

The linear compressor 100 may additionally include plate springs 172 and 174 disposed, respectively, on or at both sides of the shell 101 to allow inner components of the compressor 100 to be supported by the shell 101. The plate springs 172 and 174 may include a first plate spring 172 coupled to the first cover 102, and a second plate spring 174 coupled to the second cover 103. For example, the first plate spring 172 may be fitted into a portion at which the shell 101 and the first cover 102 are coupled to each other, and the second plate spring 174 may be fitted into a portion at which the shell 101 and the second cover 103 are coupled to each other.

Figure 2:
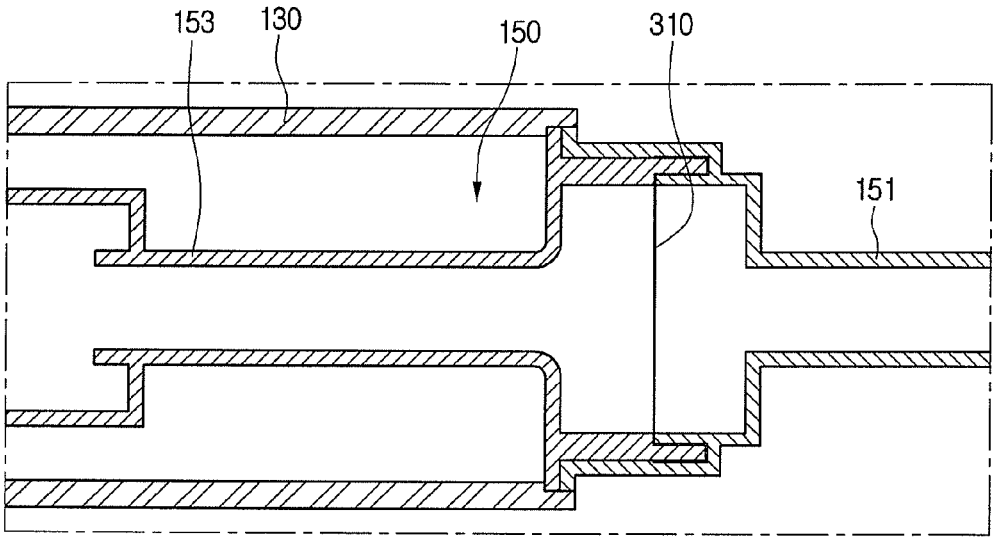
FIG. 2 is a cross-sectional view of a suction muffler of the linear compressor of FIG. 1.

FIG. 2 is a cross-sectional view of a suction muffler of the linear compressor of FIG. 1. Referring to FIG. 2, the suction muffler 150 according to this embodiment may include the first muffler 151, the second muffler 153 coupled to the first muffler 151, and a first filter 310 supported by the first and second mufflers 151 and 153.

A flow space, in which the refrigerant may flow may be defined in each of the first and second mufflers 151 and 153. The first muffler 151 may extend from an inside of the suction port 104 in a direction of the discharge port 105, and at least a portion of the first muffler 151 may extend to an inside of the suction guide 155. The second muffler 153 may extend from the first muffler 151 to an inside of the piston body 131.

The first filter 310 may refer to a component disposed in the flow space to filter foreign substances. The first filter 310 may be formed of a material having a magnetic property. Thus, foreign substances contained in the refrigerant, in particular, metallic substances, may be easily filtered. For example, the first filter 310 may be formed of stainless steel, and thus, may have a magnetic property to prevent the first filter 310 from rusting. As another example, the first filter 310 may be coated with a magnetic material, or a magnet may be attached to a surface of the first filter 310.

The first filter 310 may be provided in a mesh-type structure and have an approximately circular plate shape. Each of the filter holes may have a diameter or width less than a predetermined diameter or width. For example, the predetermined size may be about 25 μm.

The first muffler 151 and the second muffler 153 may be assembled with each other using a press-fit manner, for example. Also, the first filter 310 may be fitted into a portion into which the first and second mufflers 151 and 153 are press-fitted and then may be assembled.

For example, a groove may be defined in one of the first muffler 151 or the second muffler 153, and a protrusion inserted into the groove may be disposed on the other one of the first muffler 151 or the second muffler 153. The first filter 310 may be supported by the first and second mufflers 151 and 153 in a state in which both sides of the first filter 310 are disposed between the groove and the protrusion. In a state in which the first filter 310 is disposed between the first and second mufflers 151 and 153, when the first and second mufflers 151 and 153 move in a direction that approach each other and then are press-fitted, both sides of the first filter 310 may be inserted and fixed between the groove and the protrusion.

As described above, as the first filter 310 is provided on the suction muffler 150, foreign substances having a size greater than a predetermined size in the refrigerant suctioned in through the suction port 104 may be filtered by the first filter 310. Thus, the first filter 310 may filter the foreign substances from the refrigerant acting as the gas bearing between the piston 130 and the cylinder 120 to prevent the foreign substances from being introduced into the cylinder 120. As the first filter 310 is firmly fixed to the portion at which the first and second mufflers 151 and 153 are press-fitted, separation of the first filter 310 from the suction muffler 150 may be prevented.

Figure 3:
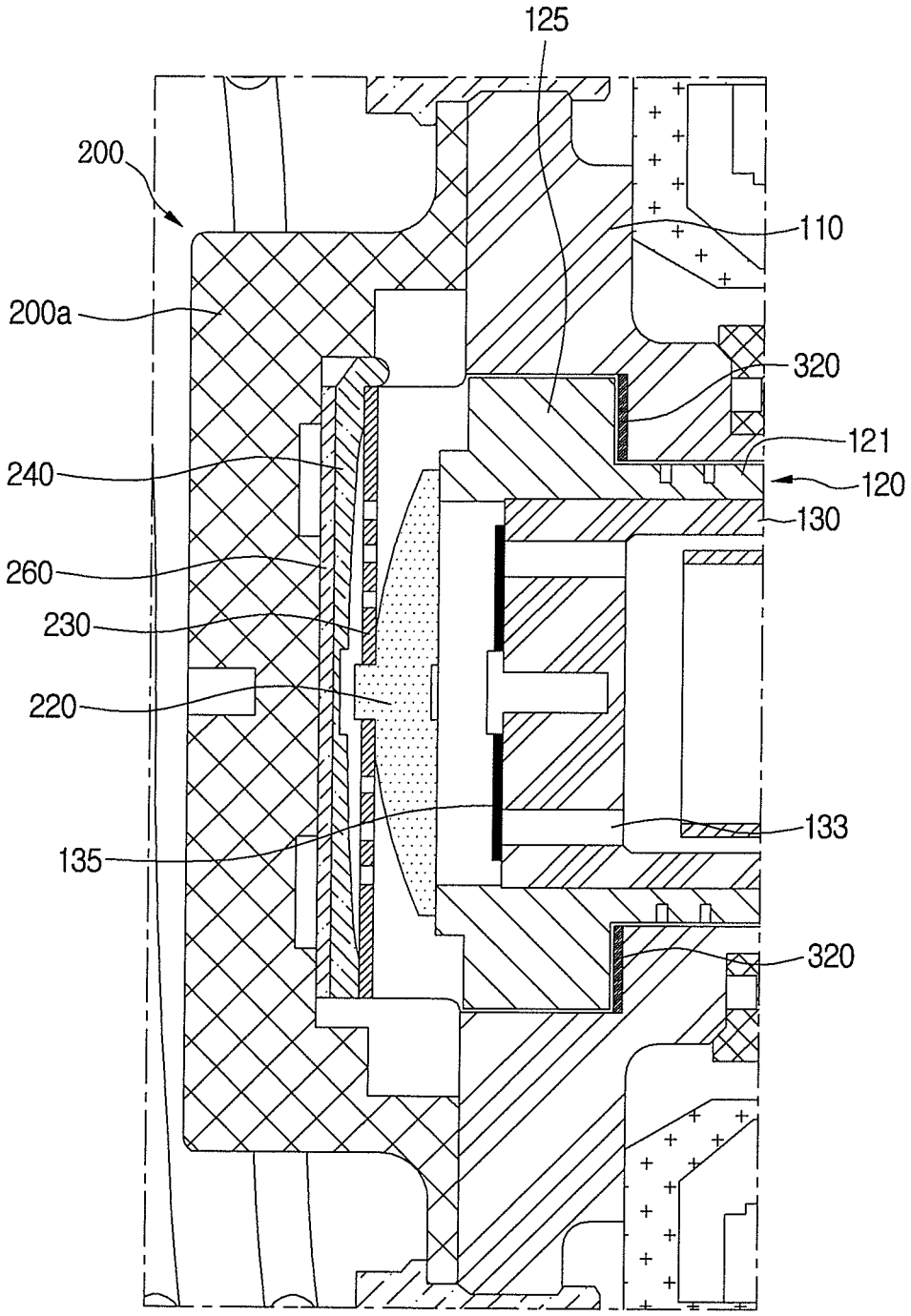
FIG. 3 is a cross-sectional of a discharge cover and a discharge valve of the linear compressor of FIG. 1.
Figure 4:
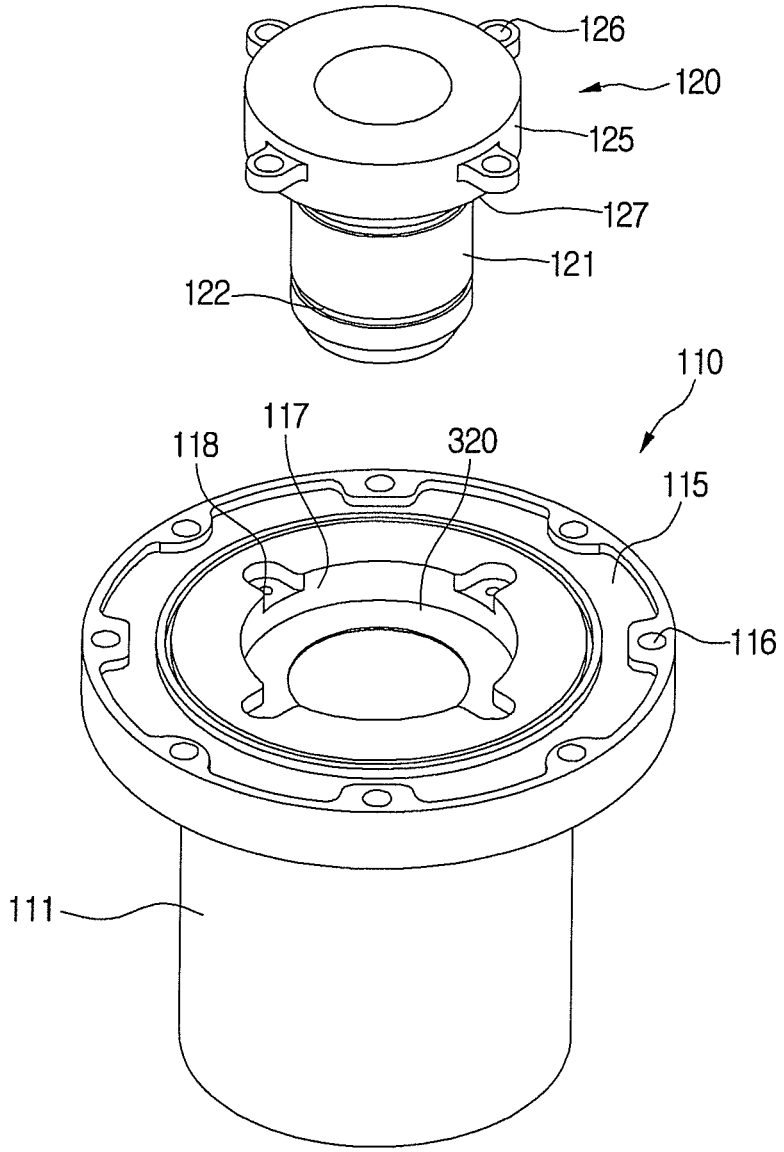
FIG. 4 is an exploded perspective view of a cylinder and a frame of the linear compressor of FIG. 1.

FIG. 3 is a cross-sectional view of a discharge cover and a discharge valve of the linear compressor of FIG. 1. FIG. 4 is an exploded perspective view of a cylinder and a frame of the linear compressor of FIG. 1.

Referring to FIGS. 3 and 4, the linear compressor 100 according to this embodiment may further include the discharge valve 220, which may be selectively opened to discharge the refrigerant compressed in the compression space P. A rear surface of the discharge valve 220 may be disposed to contact a front portion of the cylinder 120. In a state in which the rear surface of the discharge valve 220 contacts the front portion of the cylinder 120, the refrigerant within the compression space P may be compressed. When the pressure of the compression space P is above the discharge pressure, the rear surface of the discharge valve 220 may be spaced apart from the front portion of the cylinder 120 to open the discharge valve 220. Thus, the compressed refrigerant may be discharged through the space.

The linear compressor 100 may further include the valve spring 230 coupled to a front portion of the discharge valve 220 to elastically support the discharge valve 220 and the stopper 240 that restricts deformation of the valve spring 220 to a preset or predetermined degree or less.

When the discharge valve 220 is opened, the valve spring 230 may be deformed in a forward direction. In this process, the stopper 240 may interfere with the valve spring 230 at a front side of the valve spring 230 to prevent the valve spring 230 from being excessively deformed.

The linear compressor 100 may include a spacer 260 disposed on or at a front side of the stopper 240 to support the stopper 240. The spacer 260 may be seated on the discharge cover 200.

The spacer 260 may be disposed between the stopper 240 and the discharge cover 200 to stably support the stopper 240 on the discharge cover 200. Thus, when a repetitive impact occurs between the valve spring 230 and the stopper 240, damage to the stopper 240 by the discharge cover 200, in particular, a damaging phenomenon that occurs when the discharge cover 200 has a hardness greater than a hardness of the stopper 240 may be prevented.

The linear compressor 100 may include a second filter 320 disposed between the frame 110 and the cylinder 120 to filter a high-pressure gas refrigerant discharged through the discharge valve 220. The second filter 320 may be disposed on a portion of a coupled surface at which the frame 110 and the cylinder 120 are coupled to each other.

The cylinder 120 may include a cylinder body 121 having an approximately cylindrical shape, and a cylinder flange 125 that extends from the cylinder body 121 in a radial direction. The cylinder body 121 may include the gas inflow 122, through which the discharged gas refrigerant may be introduced. The gas inflow 122 may be recessed in an approximately circular shape along a circumferential surface of the cylinder body 121.

A plurality of the gas inflow 122 may be provided. The plurality of gas inflows 122 may include gas inflows (see reference numerals 122*a* and 122*b* of FIG. 6) disposed on or at one or a first side with respect to a center of the cylinder body 121 in an axial direction, and a gas inflow (see reference numeral 122*c* of FIG. 6) disposed on or at the other or a second side with respect to the center of the cylinder body 121 in the axial direction.

A coupling part or portion 126 coupled to the frame 110 may be disposed on the cylinder flange 125. The coupling portion 126 may protrude outward from an outer circumferential surface of the cylinder flange 125. The coupling portion 126 may be coupled to a cylinder coupling hole 118 of the frame 110 by a predetermined coupling member, for example.

The cylinder flange 125 may have a seat surface 127 seated on the frame 110. The seat surface 127 may be a rear surface of the cylinder flange 125 that extends from the cylinder body 121 in a radial direction.

The frame 110 may include a frame body 111 that surrounds the cylinder body 121, and a cover coupling part or portion 115 that extends in a radial direction of the frame body 111 and coupled to the discharge cover 200. The cover coupling portion 115 may have a plurality of cover coupling holes 116 in which the coupling member coupled to the discharge cover 200 may be inserted and a plurality of the cylinder coupling holes 118 in which the coupling member coupled to the cylinder flange 125 may be inserted. The cylinder coupling holes 118 may be defined in positions that are recessed somewhat from the cover coupling portion 115.

The frame 110 may include a recess 117 recessed in a backward direction from the cover coupling portion 115 to allow the cylinder flange 125 to be inserted therein. That is, the recess 117 may be disposed to surround an outer circumferential surface of the cylinder flange 125. The recess 117 may have a recessed depth corresponding to a front/rear width of the cylinder flange 125.

A predetermined refrigerant flow space may be defined between an inner circumferential surface of the recess 117 and the outer circumferential surface of the cylinder flange 125. The high-pressure gas refrigerant discharged from the discharge valve 220 may flow toward an outer circumferential surface of the cylinder body 121 via the refrigerant flow space. The second filter 320 may be disposed in the refrigerant flow space to filter the refrigerant.

A seat having a stepped portion may be disposed on or at a rear end of the recess 117. Also, the second filter 320, which may have a ring shape, may be seated on the seat.

In a state in which the second filter 320 is seated on the seat, when the cylinder 120 is coupled to the frame 110, the cylinder flange 125 may push the second filter 320 from a front side of the second filter 320. That is, the second filter 320 may be disposed and fixed between the seat of the frame 110 and the seat surface 127 of the cylinder flange 125.

The second filter 320 may prevent foreign substances in the high-pressure gas refrigerant discharged through the opened discharge valve 220 from being introduced into the gas inflow 122 of the cylinder 120 and be configured to absorb oil contained in the refrigerant. For example, the second filter 320 may include a felt formed of polyethylene terephthalate (PET) fiber, or an adsorbent paper. The PET fiber may have a superior heat-resistance and mechanical strength. A foreign substance having a size of about 2 μm or more, which may be contained in the refrigerant, may be blocked.

The high-pressure gas refrigerant passing through the flow space defined between the inner circumferential surface of the recess 117 and the outer circumferential surface of the cylinder flange 125 may pass through the second filter 320. In this process, the refrigerant may be filtered by the second filter 320.

Figure 5:
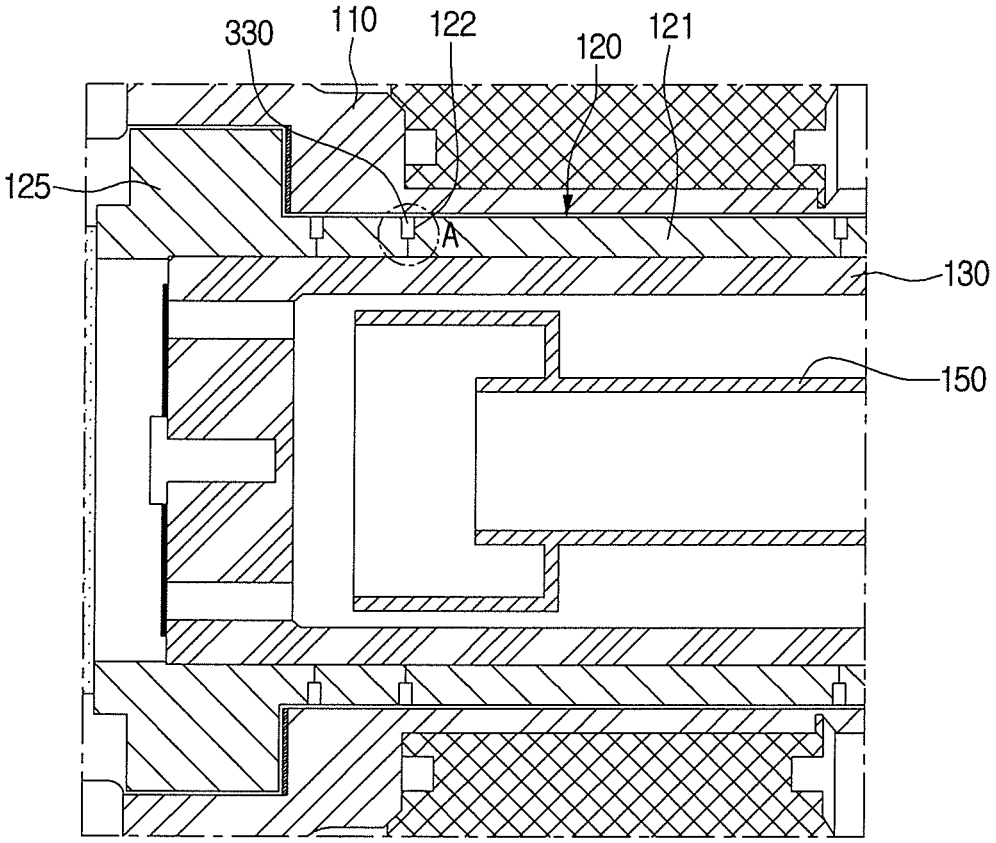
FIG. 5 is a cross-sectional view illustrating a state in which the cylinder and a piston are coupled to each other according to an embodiment.
Figure 6:
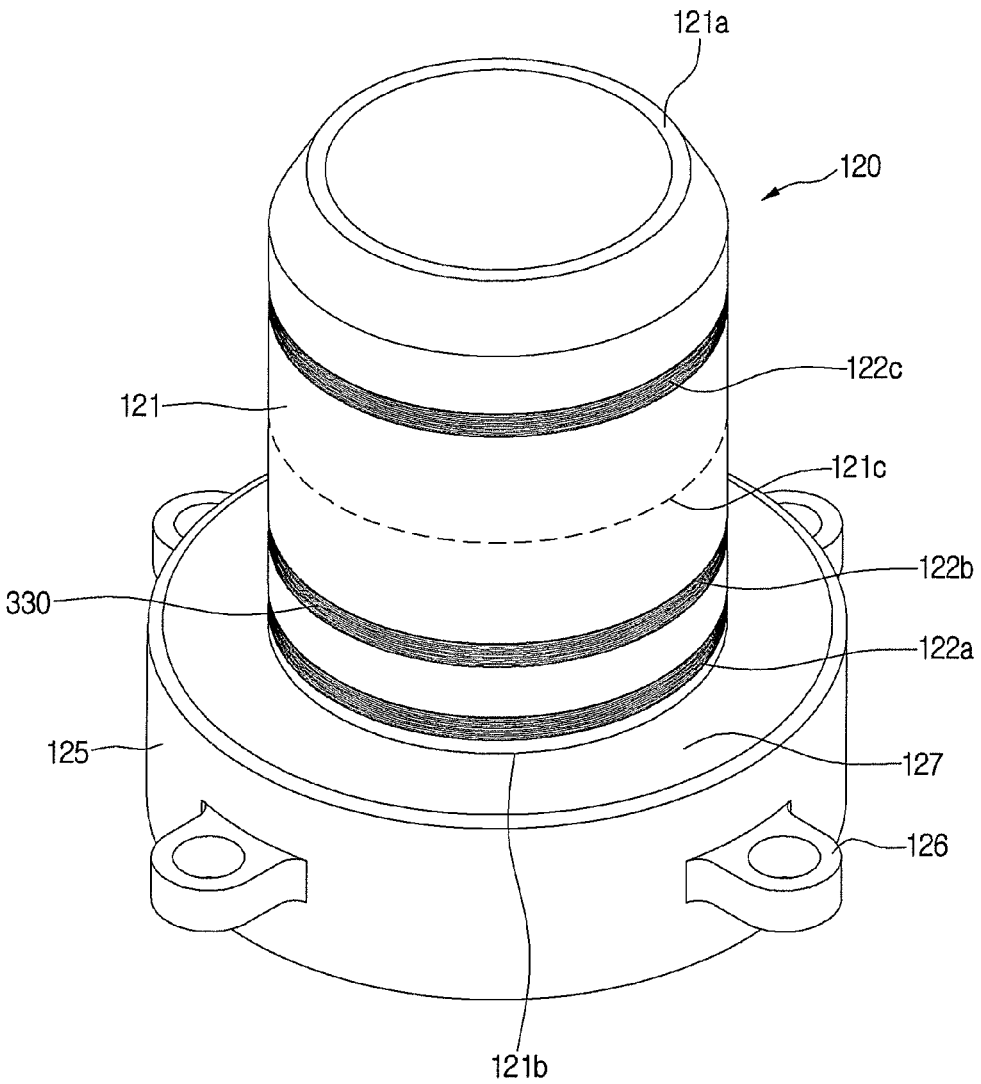
FIG. 6 is a perspective view of the cylinder of the linear compressor of FIG. 1.
Figure 7:
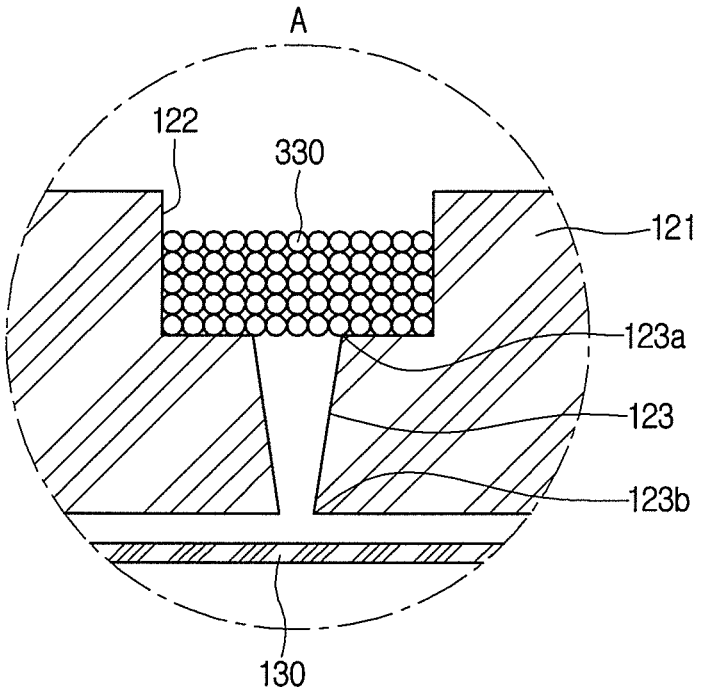
FIG. 7 is an enlarged cross-sectional view illustrating a portion A of FIG. 5.

FIG. 5 is a cross-sectional view illustrating a state in which the cylinder and the piston are coupled to each other according to an embodiment. FIG. 6 is a perspective view of the cylinder of the linear compressor of FIG. 1. FIG. 7 is an enlarged cross-sectional view illustrating a portion A of FIG. 5.

Referring to FIGS. 5 to 7, the cylinder 120 according to this embodiment may include the cylinder body 121 having an approximately cylindrical shape to form a first body end 121*a* and a second body end 121*b*, and the cylinder flange 125 that extends from the second body end 121*b* of the cylinder body 121 in a radial direction. The first body end 121*a* and the second body end 121*b* may form both ends of the cylinder body 121 with respect to a central portion 121*c* of the cylinder body 121 in an axial direction.

The cylinder body 121 may include a plurality of the gas inflows 122 through which at least a portion of the high-pressure gas refrigerant discharged through the discharge valve 220 may flow. A third filter 330 as a "filter member" may be disposed on or in the plurality of gas inflows 122.

Each of the plurality of gas inflows 122 may be recessed from the outer circumferential surface of the cylinder body 121 by a predetermined depth and width. The refrigerant may be introduced into the cylinder body 121 through the plurality of gas inflows 122 and the nozzle 123.

The introduced refrigerant may be disposed between an outer circumferential surface of the piston 130 and an inner circumferential surface of the cylinder 120 to serve as the gas bearing with respect to movement of the piston 130. That is, an outer circumferential surface of the piston 130 may be maintained in a state in which the outer circumferential surface of the piston 130 is spaced apart from an inner circumferential surface of the cylinder 120 by the pressure of the introduced refrigerant.

The plurality of gas inflows 122 may include first and second gas inflows 122*a* disposed on or at one or a first side with respect to the central portion 121*c* in the axial direction of the cylinder body 121, and a third gas inflows 122*c* disposed on the other or a second side with respect to the central portion 121*c* in the axial direction. The first and second gas inflows 122*a* and 122*b* may be disposed at positions closer to the second body end 121*b* with respect to the central portion in the axial direction of the cylinder body 121, and the third gas inflow 122*c* may be disposed at a position closer to the first body end 121*a* with respect to the central portion 121*c* in the axial direction of the cylinder body 121. That is, the plurality of gas inflows 122 may be provided in numbers that are not symmetrical to each other with respect to the central portion 121*c* in the axial direction of the cylinder body 121.

Referring to FIGS. 1 to 6, the cylinder 120 may have a relatively high inner pressure at a side of the second body end 121*b* which is closer to a discharge-side of the compressed refrigerant when compared to the first body end 121*a* which is closer to a suction-side of the refrigerant. Thus, more gas inflows 122 may be provided to or at the side of the second body end 121*b* to enhance a function of the gas bearing, and relatively less gas inflows 122 may be provided to or at the side of the first body end 121*a*.

The cylinder body 121 may further include the nozzle 123 that extends from the plurality of gas inflows 122 toward the inner circumferential surface of the cylinder body 121. The nozzle 123 may have a width or size less than a width or size of the gas inflow 122.

A plurality of the nozzle 123 may be provided along the gas inflow 122 which may extend in a circular shape. Also, the plurality of nozzles 123 may be disposed to be spaced apart from each other.

The plurality of nozzles 123 may each include an inlet 123*a* connected to the gas inflow 122 and an outlet 123*b* connected to the inner circumferential surface of the cylinder body 121. The nozzle 123 may have a predetermined length from the inlet 123*a* toward the outlet 123*b*.

The refrigerant introduced into the gas inflow 122 may be filtered by the third filter 330 to flow into the inlet 123*a* of the nozzle 123 and then flow toward the inner circumferential surface of the cylinder 120 along the nozzle 123. The refrigerant may be introduced into an inner space of the cylinder 120 through the outlet 123*b*.

The piston 130 may operate to be spaced apart from the inner circumferential surface of the cylinder 120, that is, may be lifted from the inner circumferential surface of the cylinder 120 by the pressure of the refrigerant discharged from the outlet 123*b*. That is, the pressure of the refrigerant supplied into the cylinder 120 may provide a lifting force or pressure to the piston 130.

A recessed depth and width of each of the plurality of gas inflows 122 and a length of the nozzle 123 may be determined to have adequate dimensions in consideration of a rigidity of the cylinder 120, an amount of the third filter 330, or an intensity in pressure drop of the refrigerant passing through the nozzle 123.

For example, if the recessed depth and width of each of the plurality of gas inflows 122 are very large, or a length of the nozzle 123 is very short, the rigidity of the cylinder 120 may be weak. On the other hand, if the recessed depth and width of each of the plurality of gas inflows 122 are very small, an amount of the third filter 330 provided in the gas inflow 122 may be very small. Also, if the length of the nozzle 123 is too long, the pressure drop of the refrigerant passing through the nozzle 123 may be too large, and it may be difficult to perform the function as the gas bearing.

The inlet 123*a* of the nozzle 123 may have a diameter greater than a diameter of the outlet 123*b*. In a flow direction of the refrigerant, a flow section area of the nozzle 123 may gradually decrease from the inlet 123*a* to the outlet 123*b*.

In detail, if the diameter of the nozzle 123 is too small, an amount of refrigerant, which is introduced from the nozzle 123, of the high-pressure gas refrigerant discharged through the discharge valve 220 may be too large, increasing flow loss in the linear compressor 100. On the other hand, if the diameter of the nozzle 123 is too small, a pressure drop in the nozzle 123 may increase, reducing performance of the gas bearing.

Thus, in this embodiment, the inlet 123*a* of the nozzle 123 may have a relatively large diameter to reduce the pressure drop of the refrigerant introduced into the nozzle 123. In addition, the outlet 123*b* may have a relatively small diameter to control an inflow amount of gas bearing through the nozzle 123 to a predetermined value or less.

The third filter 330 may prevent a foreign substance having a predetermined size or more from being introduced into the cylinder 120 and perform a function of absorbing oil contained in the refrigerant. The predetermined size may be about 1 μm, for example.

The third filter 330 may include a thread wound around the gas inflow 122. The thread may be formed of a polyethylene terephthalate (PET) material and have a predetermined thickness or diameter, for example.

The thickness or diameter of the thread may be determined to have adequate dimensions in consideration of a rigidity of the thread. If the thickness or diameter of the thread is too small, the thread may be easily broken due to a very weak strength thereof. On the other hand, if the thickness or diameter of the thread is too large, a filtering effect with respect to the foreign substances may be deteriorated due to a very large pore in the gas inflow 122 when the thread is wound.

For example, the thickness or diameter of the thread may be several hundreds μm. The thread may be manufactured by coupling a plurality of strands of a spun thread having several tens μm to each other, for example.

The thread may be wound several times, and an end of the thread may be fixed through or by a knot. A wound number of the thread may be adequately selected in consideration of the pressure drop of the gas refrigerant and the filtering effect with respect to foreign substances. If the wound number of thread is too large, the pressure drop of the gas refrigerant may increase. On the other hand, if the wound number of thread is too small, the filtering effect with respect to foreign substances may be reduced.

Also, a tension force of the wound thread may be adequately controlled in consideration of a strain of the cylinder 120 and fixation of the thread. If the tension force is too large, deformation of the cylinder 120 may occur. On the other hand, if the tension force is too small, the thread may not be well fixed to the gas inflow 122.

Figure 8:
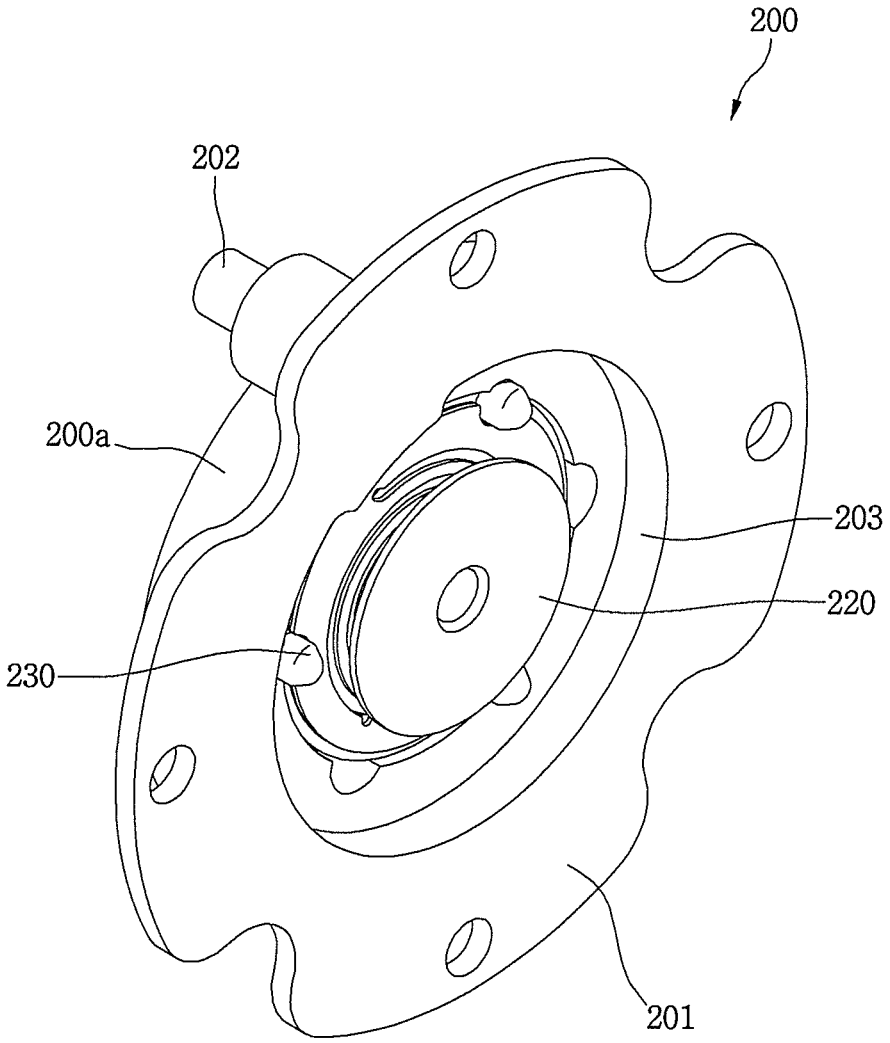
FIG. 8 is a perspective view of a discharge valve coupled to the discharge cover according to an embodiment.
Figure 9:
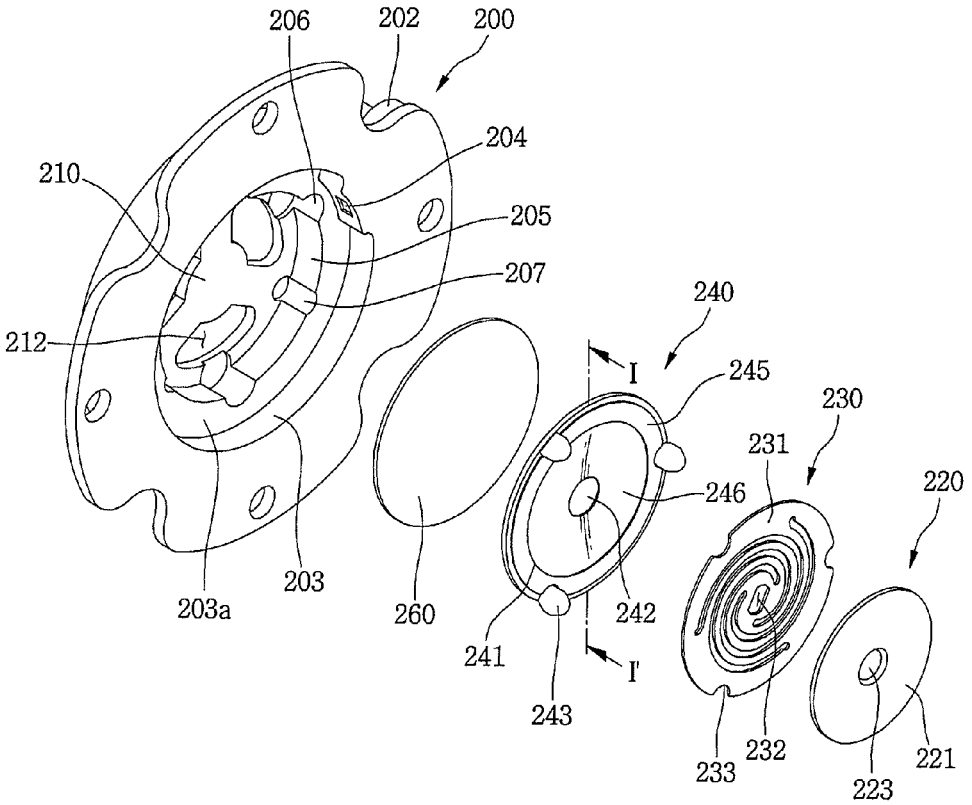
FIG. 9 is an exploded perspective view of the discharge cover and the discharge valve of FIG. 8.
Figure 10:
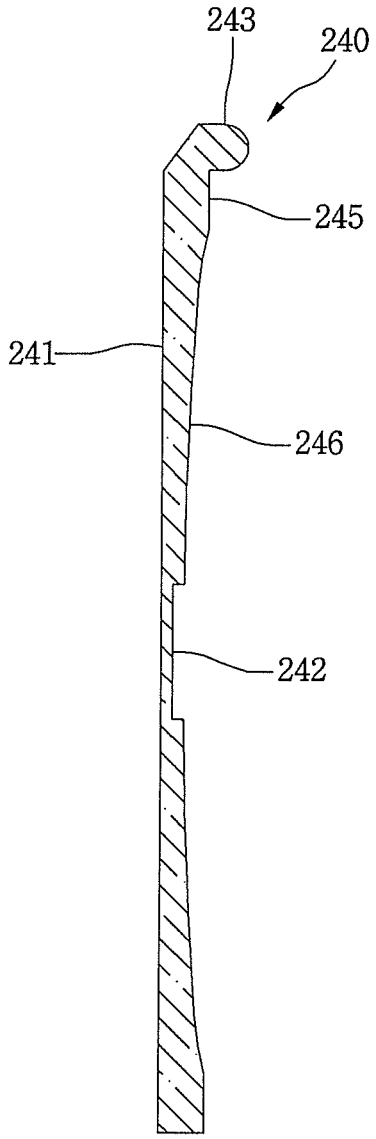
FIG. 10 is a cross-sectional view taken along line X-X' of FIG. 9.
Figure 11:
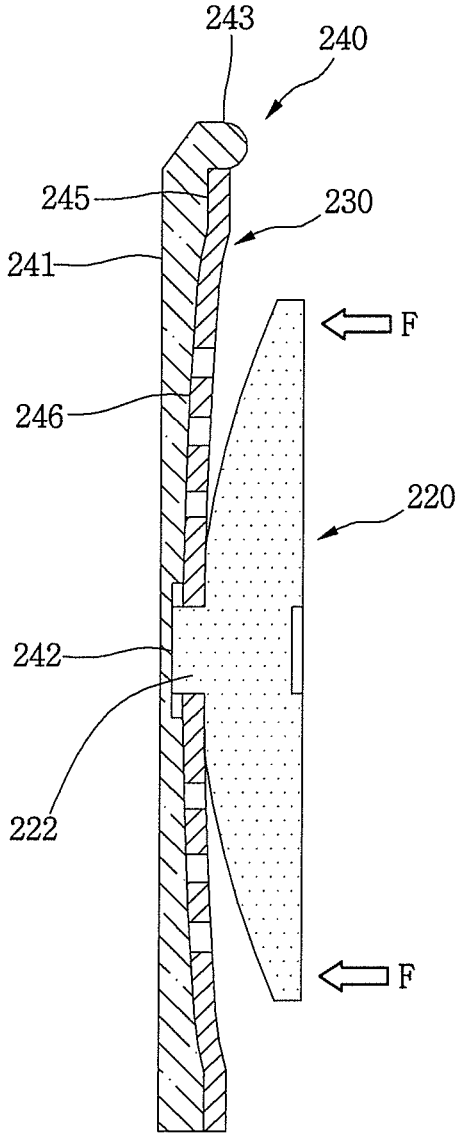
FIG. 11 is a cross-sectional view illustrating an interaction between a valve spring and a stopper according to an embodiment.

FIG. 8 is a perspective view of a discharge valve assembly coupled to the discharge cover according to an embodiment. FIG. 9 is an exploded perspective view of the discharge cover and the discharge valve of FIG. 8. FIG. 10 is a cross-sectional view taken along line X-X' of FIG. 9. FIG. 11 is a cross-sectional view illustrating an interaction between a valve spring and a stopper according to an embodiment.

Referring to FIGS. 8 to 11, the linear compressor 100 according to this embodiment may include the discharge cover 200 coupled to a front portion of the frame 110 to define a discharge passage of the refrigerant discharged from the compression space P. The discharge cover 200 may include a cover body 200*a* that defines a discharge passage of the refrigerant discharged through the discharge valve 220, a frame coupling part or portion 201 that extends from the cover body 200*a* in a radial direction and coupled to the frame 110, and a pipe connection part or portion 202 that protrudes from the cover body 200*a* and discharges the refrigerant passing through the discharge passage of the discharge body 200*a* outside of the discharge cover 200. The frame coupling portion 201 may be disposed on or at a rear surface of the discharge cover 200, and the pipe connection portion 202 may be connected to the loop pipe 165.

The discharge valve assembly 220, 230, 240 may be disposed on the discharge cover 200. The discharge valve assembly 220, 230, 240 may include the discharge valve 220, the valve spring 230, the stopper 240, and the spacer 260. The cover body 200*a* of the discharge cover 200 may include a plurality of steps 203 and 205 stepped in a forward direction from the frame coupling portion 201. The plurality of steps 203 and 205 may include a first step 203 recessed in a backward direction from the frame coupling portion 201, and a second step 205 further recessed from the first step 203 toward a resonance chamber 212.

The cover body 200*a* may further include a step connection part or portion 203*a* that extends inward from the first step 203 in the radial direction and connected to the second step 205. That is, in the cover body 200*a*, the first step 203 may extend inward in the radial direction, and then, may be further recessed backward to form the second step 205.

The first step 203 may include a discharge hole 204 to guide the refrigerant passing through the discharge passage of the cover body 200*a* into the pipe connection portion 202 to discharge the refrigerant from the discharge cover 200. The discharge hole 204 may pass through at least a portion of the first step 203. The refrigerant discharged through the discharge valve 220 may flow into the pipe connection portion 202 via the discharge hole 204.

The cover body 200*a* may further include the resonance chamber 212, which may be further recessed from the second step 205, to define a space to reduce pulsation of the refrigerant. A plurality of the resonance chamber 212 may be provided. At least a portion of the refrigerant discharged through the discharge valve 220 may flow into the space of the resonance chamber 212.

The cover body 200*a* may further include a seat 210 to partition the plurality of resonance chambers 212 and support the spacer 260. The plurality of resonance chambers 212 may be further recessed forward from the seat 210 and disposed to be spaced apart from each other by the seat 210.

A first guide groove 206 that guides at least a portion of the refrigerant discharged through the discharge valve 220 into the plurality of resonance chambers 212 may be defined in the cover body 200*a* as a "gas passage". The first guide groove 206 may extend forward from the step connection portion 203*a* toward the second step 205. At least portions of the step connection portion 203*a* and the second step 205 may be cut to define the first guide groove 206.

A plurality of the first guide groove 206 may be provided to correspond to a number of the resonance chambers 212. The plurality of first guide grooves 206 may be defined to be spaced apart from each other. As at least a portion of the refrigerant discharged through the opened discharge valve 220 may be introduced into the plurality of resonance chambers 212 along the first guide groove 206, pulsation generated when the refrigerant flows while the linear compressor 100 operates may be reduced.

A second guide groove 207 that guides coupling of the stopper 240 may be defined in the cover body 200*a*. The second guide groove 207 may guide coupling between the stopper 240 and a guide protrusion 243. At least portions of the step connection portion 203*a* and the second step 205 may be cut to define the second guide groove 207.

A plurality of the first guide groove 207 may be provided to correspond to a number of the guide protrusions 243 of the stopper 240. The plurality of second guide grooves 207 may be defined to be spaced apart from each other.

The discharge valve 220 may include a valve body 221 selectively attached to a front surface of the cylinder flange 125 of the cylinder 120, and a valve recess 223 recessed in a forward direction from the valve body 221. The valve recess 223 may be referred to as an "interference prevention groove" that prevents at least a portion of the piston 130 from interfering with the discharge valve 220 while the piston 130 move forward to compress the refrigerant. At least a portion of the piston 130 may include a coupling member that couples the suction valve 135 to the piston 130.

The discharge valve 220 may further include an insertion protrusion 222 that protrudes in a forward direction from the valve body 221 and coupled to the valve spring 230. The insertion protrusion 222 may be coupled to an insertion hole 232 defined in the valve spring 230.

Each of the insertion protrusion 222 and the insertion hole 232 may have a noncircular cross-sectional shape. For example, the cross-sectional shape may be a polygonal shape. Thus, when the discharge valve 220 is opened or closed in a state in which the insertion protrusion 222 is inserted into the insertion hole 232, it may prevent the discharge valve 220 from rotating. As a result, it may prevent the discharge valve 220 from being behaving unstably. In particular, if the gas bearing instead of the oil bearing is used in the linear compressor as described above, as there is no lubrication action for the discharge valve by the oil, abrasion of the discharge valve due to unstable behavior may be reduced.

The valve spring 230 may include a plate spring and have an approximately circular plate shape. The valve spring 230 may be coupled to a front portion of the discharge valve 220 to allow the discharge valve 220 to elastically move. The valve spring 230 may include a spring body 231 having a plurality of cutoffs, and the insertion hole 232 defined in an approximately central portion of the spring body 231 and in which the insertion protrusion 222 of the discharge valve 220 may be inserted.

The plurality of cutoffs may have a spiral shape. Also, the valve spring 230 may be elastically deformed by the plurality of cutoffs.

The valve spring 230 may include a spring recess 233 recessed from an outer circumferential surface of the spring body 231. The spring recess 233 may guide a position of the guide protrusion 243 of the stopper 240.

The stopper 240 may be disposed on or at a front side of the valve spring 230. The stopper 240 may include a stopper body 241 that restricts deformation of the valve spring 230 when the valve spring 230 is deformed. The stopper body 241 may have an approximately circular plate shape. When the valve spring 230 is deformed by a preset or predetermined degree or more, the stopper body 241 may be disposed at a position at which the stopper body 241 interferes with the valve spring 230.

The stopper 240 may further include a valve avoidance groove 242 recessed in a forward direction in the stopper body 241. The valve avoidance groove 242 may be recessed from an approximately central portion of the stopper body 241 to prevent the stopper body 241 from interfering with the insertion protrusion 222 of the discharge valve 220.

That is, when the insertion protrusion 222 moves forward while the discharge valve 220 is opened, the valve avoidance groove 242 may provide an interference avoidance space so that the stopper body 241 does not interfere with the insertion protrusion 222. The valve avoidance groove 242 may be defined in or at a position corresponding to the insertion protrusion 222, that is, defined in a path along which the insertion protrusion 222 may move.

The stopper 240 may further includes a spring support 245 disposed along a circumference of the stopper body 241 to protrude toward the valve spring 230. That is, the spring support 245 may protrude in a backward direction.

The spring support 245 may support the valve spring 230, and the valve spring 230 may be seated on the spring support 245. The stopper body 241 may be spaced apart from the valve spring 230 by the spring support 245.

Also, when the discharge valve 220 is opened, and thus, the valve spring 230 is deformed in the forward direction, the stopper body 241 may interfere with the valve spring 230. For example, the stopper body 241 may contact the valve spring 230.

The stopper body 241 may include a guide 246 to increase a contact area with the valve spring 230 when the valve spring 230 is deformed. The guide 246 may be recessed from a rear surface of the stopper body 241 in a direction in which the valve spring 230 is deformed, that is, in a frontward direction.

The guide 246 may be recessed from the spring support 245 toward the valve avoidance groove 242. For example, the guide 246 may extend to be rounded from the spring support 245 to the valve avoidance groove 242. That is, the guide 246 may extend to be rounded and include a contact surface that contacts the valve spring 230.

The valve spring 230 may be deformed in the forward direction with respect to the insertion hole 232 to which a force may be applied from the discharge valve 220 when the discharge valve 220 is opened. That is, the valve spring 230 may be deformed at an incline from the insertion hole 232 toward an outer circumference of the valve spring 230. The rounded surface of the guide 246 may have a shape corresponding to the deformed shape of the valve spring 230.

If the guide device 246 may have a vertical surface in a radial direction, when the valve spring 230 is deformed, the stopper 240 may contact the valve spring 230 on only a predetermined portion around the valve avoidance groove 242. In this case, as a load is applied to only a portion of the stopper 240, an impulse applied to the valve spring 230 or the stopper 240 may increase. In this embodiment, it is intended to prevent the above-described limitation from occurring.

Referring to FIG. 11, when a pressure of the compression space P is above the discharge pressure, a predetermined force F may be applied to a rear surface of the discharge valve 220. Thus, the discharge valve 220 may be moved in the forward direction by the force F to open the compression space P.

The valve spring 230 may receive the force from the discharge valve 220, and thus, may be deformed in the forward direction. In particular, the valve spring 230 may receive the force by which the valve spring 230 is deformed in the forward direction with respect to the insertion hole 232 coupled to the insertion protrusion 222. Thus, the valve spring 230 may be inclinedly deformed from the insertion hole 232 in an outer radial direction.

As described above, as the stopper 240 may include the guide 246 which is recessed in a shape corresponding to the deformation of the valve spring 230, the guide 246 may stably support the valve spring 230. That is, a contact area between the stopper 240 and the valve spring 230 may be increased by the guide 246. As a result, while the discharge valve 220 is deformed, an impulse between the stopper 240 and the valve spring 230 may be reduced.

The stopper 240 may further include the guide protrusion 243 that protrudes in the backward direction from the rear surface of the stopper body 241 to guide coupling of the discharge cover 200. The guide protrusion 243 may protrude from the edge of the stopper body 241 on which the spring support 245 is disposed. A plurality of the guide protrusion 243 may be provided. The plurality of guide protrusions 243 may be disposed to be spaced apart from each other.

When the stopper 240 is coupled to the discharge cover 200, the guide protrusion 243 may move into the cover body 200*a* along the second guide groove 207. The guide protrusion 243 may be coupled to the spring recess 233 of the valve spring 230. Thus, the valve spring 230 may be stably coupled to the stopper 240.

For example, the stopper 240 may be press-fitted into and fixed to the second guide groove 207 in a state in which the guide protrusion 243 is coupled to the spring recess 233. Thus, the stopper 240 may be stably coupled to the discharge cover 200 without using a separate coupling member.

The spacer 260 may be seated on the seat 210 of the cover body 200*a* to support the stopper 240. That is, the spacer 260 may be disposed between the seat 210 and the stopper 240 to prevent the stopper 240 from directly colliding with the discharge cover 200.

Figure 12:
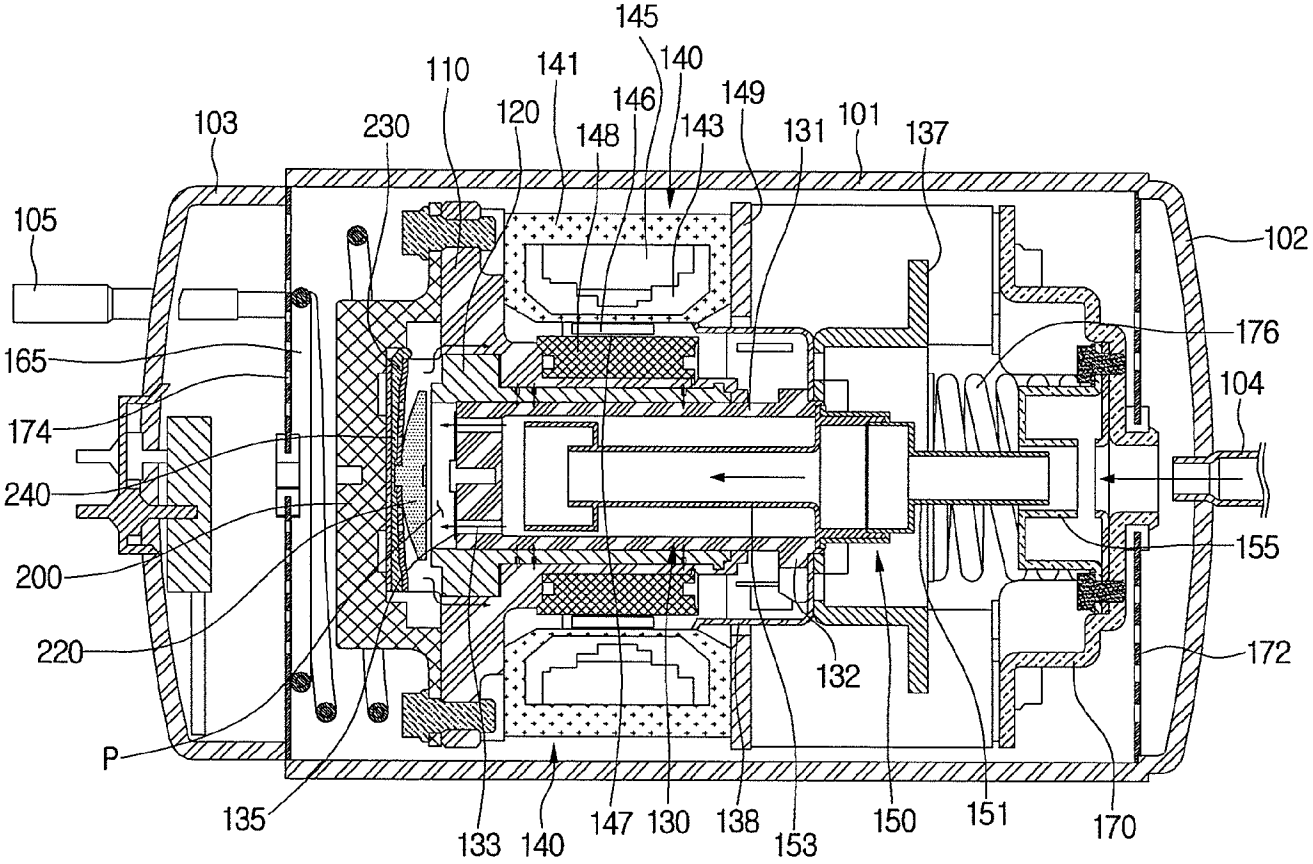
FIG. 12 is a cross-sectional view illustrating a flow of a refrigerant in the linear compressor of FIG. 1.
Figure 13:
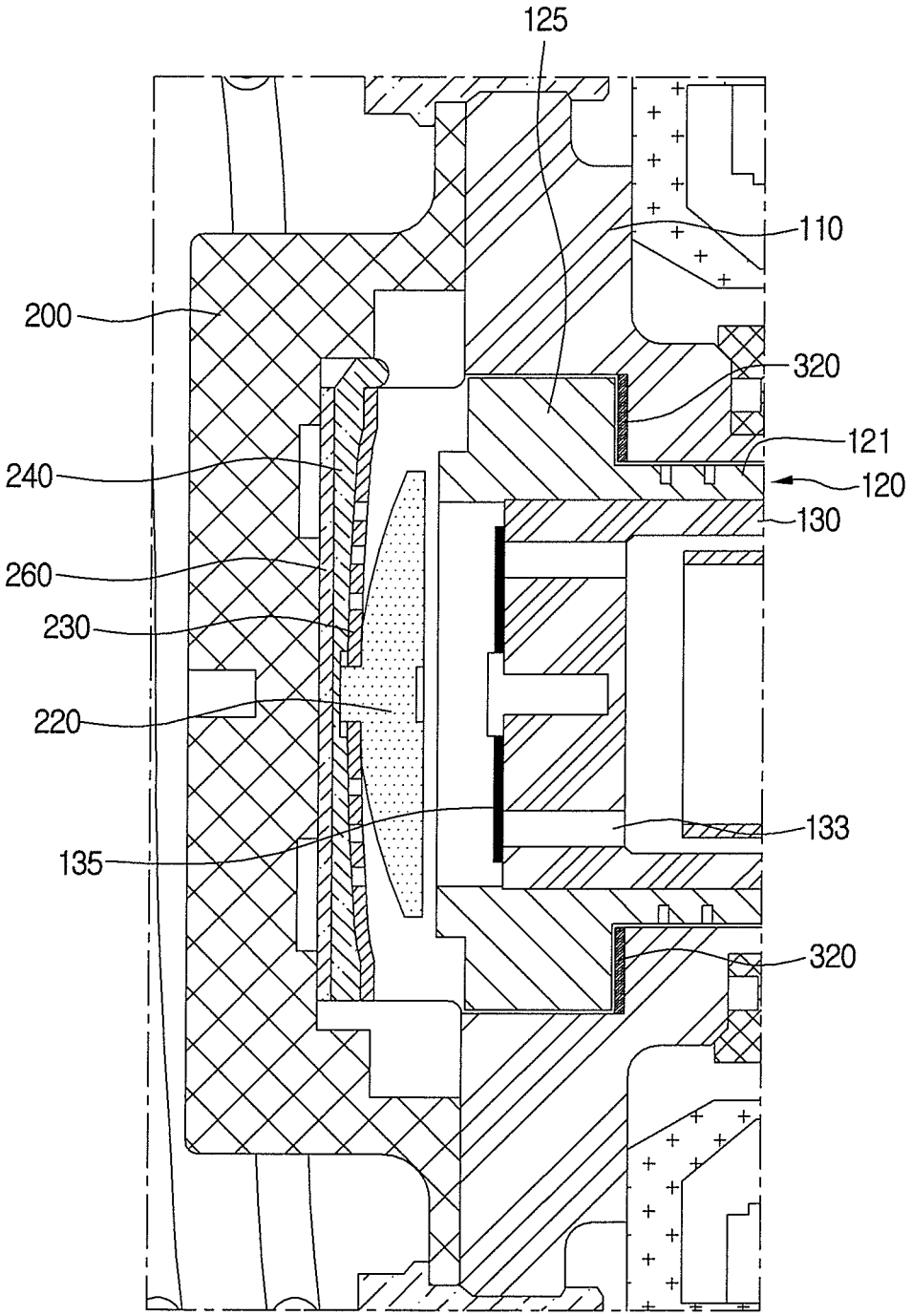
FIG. 13 is a cross-sectional view of a discharge valve opened when the linear compressor of FIG. 1 operates.

FIG. 12 is a cross-sectional view illustrating a flow of a refrigerant in the linear compressor of FIG. 1. FIG. 13 is a cross-sectional view of a discharge valve opened when the linear compressor of FIG. 1 operates.

Referring to FIG. 12, the refrigerant may be introduced into the shell 101 through the suction port 104 and flow into the suction muffler 150 through the suction guide 155. The refrigerant may be introduced into the second muffler 153 via the first muffler 151 of the suction muffler 150 to flow into the piston 130. With this process, suction noise of the refrigerant may be reduced.

A foreign substance having a predetermined size (about 25 μm) or more, which is contained in the refrigerant, may be filtered while passing through the first filter 310 provided on the suction muffler 150. The refrigerant within the piston 130 after passing though the suction muffler 150 may be suctioned into the compression space P through the suction hole 133 when the suction valve 135 is opened.

When the refrigerant pressure in the compression space P is above the discharge pressure, the discharge valve 220 may be opened. Thus, the refrigerant may be discharged into the discharge space of the discharge cover 220 through the opened discharge valve 220, flow into the discharge port 105 through the loop pipe 165 coupled to the discharge cover 200, and be discharged outside of the linear compressor 100.

When the discharge valve 220 is opened, the valve spring 230 may be elastically deformed in the forward direction. With this process, the stopper 240 may prevent the valve spring 230 from being deformed by a preset or predetermined degree or more.

In particular, with this embodiment, when the linear compressor 100 operates at a high frequency, an opening degree of the discharge valve 220, that is, movement of the discharge valve 220 may increase. Thus, when the discharge valve 220 is closed, an impulse applied to the discharge valve 220 may increase to increase abrasion of the discharge valve 220. In particular, when the gas bearing is applied without using oil, abrasion may increase.

Thus, in this embodiment, the discharge valve 220 may be elastically supported by the valve spring 230, and the stopper 240 may be disposed on or at one side of the valve spring 230 to restrict the opening degree of the discharge valve 220. Also, the stopper 240 may include the guide 246 recessed in a direction in which the valve spring 230 is deformed, and the guide 246 may be rounded in a shape corresponding to a deformation of the valve spring 230. Thus, the contact area between the stopper 240 and the valve spring 230 may increase. Thus, an impulse between the stopper 240 and the valve spring 230 may be reduced.

At least one portion of the refrigerant within the discharge space of the discharge cover 200 may flow toward the outer circumferential surface of the cylinder body 121 via the space defined between the cylinder 120 and the frame 110, that is, the inner circumferential surface of the recess 117 of the frame 110 and the outer circumferential surface of the cylinder flange 121 of the cylinder 120. The refrigerant may pass through the second filter 320 disposed between the seat surface 127 of the cylinder flange 125 and the seat 113 of the frame 110. With this process, a foreign substance having a predetermined size (about 2 μm) or more may be filtered. Also, oil of the refrigerant may be adsorbed onto or into the second filter 320.

The refrigerant passing through the second filter 320 may be introduced into the plurality of gas inflows 122 defined in the outer circumferential surface of the cylinder body 121. Also, while the refrigerant passes through the third filter 330 provided on the plurality of gas inflows 122, a foreign substances having a predetermined size (about 1 μm) or more, which is contained in the refrigerant, may be filtered, and the oil contained in the refrigerant may be adsorbed.

The refrigerant passing through the third filter 330 may be introduced into the cylinder 120 through the nozzle 123 and be disposed between the inner circumferential surface of the cylinder 120 and the outer circumferential surface of the piston 130 to space the piston 130 from the inner circumferential surface of the cylinder 120 (gas bearing). The inlet 123*a* of the nozzle 123 may have a diameter greater than a diameter of the outlet 123*b*. Thus, a refrigerant flow section area on the nozzle 123 may gradually decrease with respect to a flow direction of the refrigerant. For example, the inlet 123*a* may have a diameter greater two times than the diameter of the outlet 123*b*.

As described above, the high-pressure gas refrigerant may be bypassed within the cylinder 120 to serve as the gas bearing with respect to the piston 130 which is reciprocated, thereby reducing abrasion between the piston 130 and the cylinder 120. Also, as oil for the bearing is not used, friction loss due to oil may not occur even though the linear compressor 100 operates at a high rate.

Further, as the plurality of filters are provided in the passage of the refrigerant flowing in the linear compressor 100, foreign substances contained in the refrigerant may be removed. Thus, the refrigerant acting as the gas bearing may be improved in reliability. Thus, it may prevent the piston 130 or the cylinder 120 from being worn by the foreign substances contained in the refrigerant.

Furthermore, as the oil contained in the refrigerant is removed by the plurality of filters, it may prevent friction loss due to the oil from occurring. The first, second, and third filters 310, 320, and 330 may be referred to as a "refrigerant filter" in that the filters 310, 320, and 330 filter the refrigerant that serves as the gas bearing.

Hereinafter, a description will be made according to another embodiment. As this embodiment may be similar to the previous embodiment except for a structure of a discharge valve assembly, different components therebetween will be described principally, descriptions of the same or similar components will be denoted by the same or similar reference numerals, and repetitive disclosure has been omitted.

Figure 14:
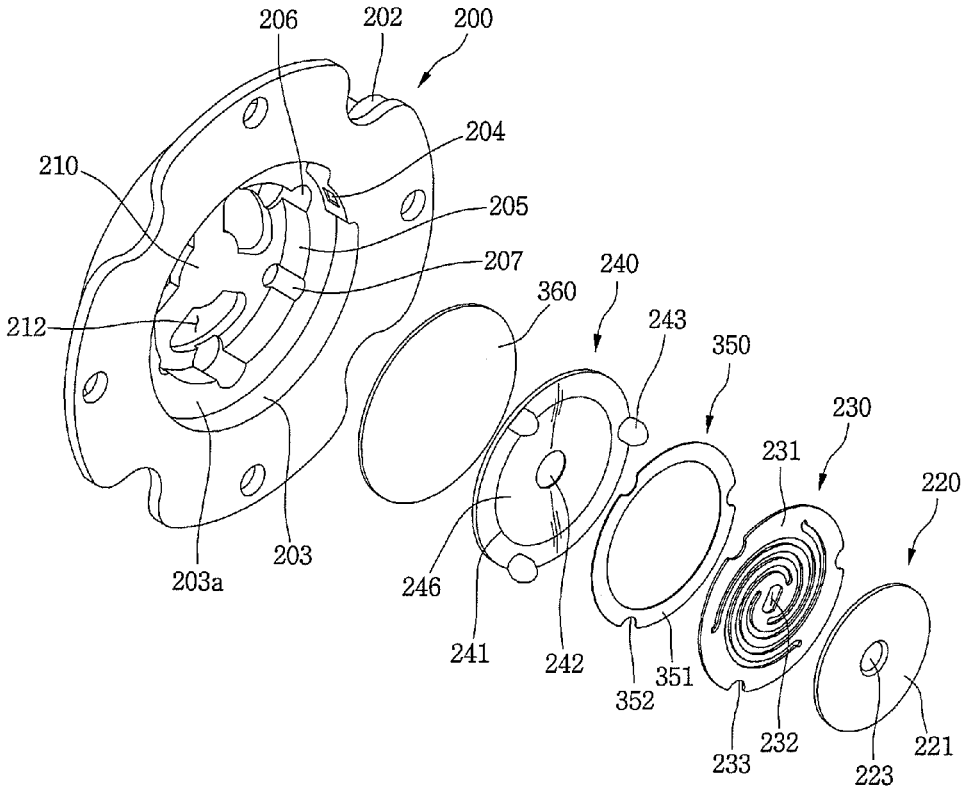
FIG. 14 is an exploded perspective view of a discharge cover and a discharge valve assembly according to another embodiment.

FIG. 14 is an exploded perspective view of a discharge cover and a discharge valve assembly according to another embodiment. Referring to FIG. 14, a discharge valve assembly according to this embodiment may include a plurality of spacers 350 and 360 disposed on or at first and second sides of stopper 240.

The plurality of spacers 350 and 360 may include a first spacer 350 disposed between valve spring 230 and the stopper 240, and a second spacer 360 disposed on or at a front side of the stopper 240. The first spacer 350 may space the valve spring 230 from the stopper 240 by a preset or predetermined distance to secure a space in which the valve spring 230 may be deformed. The preset or predetermined distance may be determined by an adjustable thickness of the first spacer 350. The second spacer 360 may be disposed between the stopper 240 and the discharge cover 200 to stably support the stopper 240 on the discharge cover 200.

When compared to the previous embodiment, the second spacer 360 may correspond to the spacer 260, and the first spacer 350 may be provided as a component which is separate from the spring support 245 of the previous embodiment. The first spacer 350 may be separably coupled to an edge of stopper body 241. The first spacer 350 may include a spacer body 351 having an approximately ring shape, and a spacer groove 351 recessed from an outer circumferential surface of the spacer body 352 to guide a position of guide protrusion 243 of the stopper 240.

Guide 246 may extend from an inner circumferential surface of the first spacer 350 to valve avoidance groove 242. As described with respect to the previous embodiment, the guide 246 may have a rounded surface recessed in a space corresponding to deformation of the valve spring 230.

Figure 15:
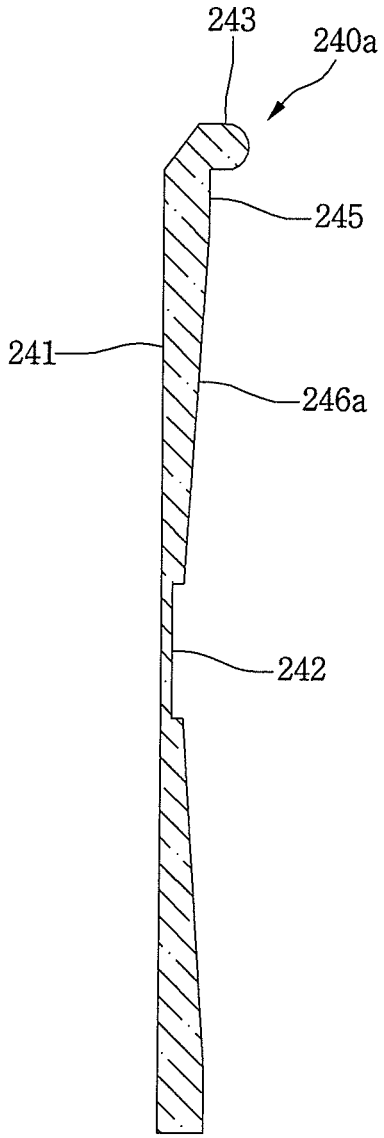
FIG. 15 is a cross-sectional view of a stopper according to another embodiment.

FIG. 15 is a cross-sectional view of a stopper according to another embodiment. Referring to FIG. 15, stopper **240*a* according to this embodiment may include a guide 246*a* recessed in a direction in which valve spring 230** is deformed, that is, in a frontward direction.

The guide **246*a* may extend at an incline from the spring support 245 in an inner radial direction. That is, the guide 246*a* may be different from the guide 246 according to the previous embodiment in that the guide 246*a*** does not have a rounded contact surface, but rather, has an inclined contact surface.

As the guide **246*a* is disposed on the stopper 240, a contact area between the stopper 240 and the valve spring 230 may increase while discharge valve 220 is opened. Thus, an impulse between the stopper 240 and the valve spring 230** may be reduced.

According to embodiments, the linear compressor including the inner components may be decreased in size to reduce a volume of a machine room of a refrigerator and increase an inner storage space of the refrigerant. Also, a drive frequency of the linear compressor may be increased to prevent performance of inner components from being deteriorated due to the decreasing size thereof. In addition, as the gas bearing is applied between the cylinder and the piston, a friction force occurring due to oil may be reduced.

Further, the discharge valve to selectively discharge the high-pressure gas compressed in the compression chamber may stably operate. In addition, an impulse occurring while the discharge valve operates may be reduced, reducing abrasion of the discharge valve. As a result, it may prevent foreign substances generated due to the abrasion of the discharge valve from having an influence on the gas bearing.

Furthermore, an opening degree of the discharge valve may be restricted by the stopper to reduce a time taken to close the discharge valve, thereby improving a response for operating the discharge valve. Also, as the stopper has one inclined surface to allow the valve spring that supports the discharge valve to have surface-contact with the inclined surface of the stopper when the discharge valve is opened, the contact area between the stopper and the valve spring may increase. Thus, the impulse occurring between the discharge valve or valve spring and the stopper may decrease, reducing abrasion of the discharge valve.

Additionally, a resonance chamber may be provided in the discharge cover to reduce pulsation of the discharge gas, thereby reducing noise. Also; as the plurality of filtering device is provided in the linear compressor, it may prevent foreign substances or oil contained in the compression gas (or discharge gas) introduced to an outside of the piston from the nozzle of the cylinder from being introduced. Therefore, as blocking of the nozzle of the cylinder is prevented, the gas bearing effect may be effectively performed between the cylinder and the piston, and thus, abrasion of the cylinder and the piston may be prevented.

Embodiments disclosed herein provide a linear compressor in which abrasion of a discharge valve may be reduced.

Embodiments disclosed herein provide a linear compressor that may include a shell in which a discharge port is provided; a cylinder disposed in the shell to define a compression space for a refrigerant; a piston disposed to be reciprocated in an axial direction within the cylinder; a discharge valve disposed on or at one side of the cylinder to selectively discharge the refrigerant compressed in the compression space; a valve spring coupled to the discharge valve to provide a restoring force; and a stopper coupled to the valve spring to restrict deformation of the valve spring. The stopper may include a guide device or guide that is recessed in a direction in which the valve spring is deformed to reduce an impulse between the stopper and the valve spring.

The guide device may include a contact surface that contacts the valve spring. The contact surface may include a surface that extends to be rounded. The contact surface may include a surface that inclinedly extends in a radial direction perpendicular to an axial direction.

The stopper may include a stopper body that supports the valve spring; a spring support disposed on or at an edge of the stopper body to support the valve spring; and a valve avoidance groove defined in or at a central portion of the stopper body to prevent the stopper body from interfering with the discharge valve. The guide device may extend from the spring support toward the valve avoidance groove. The spring support may protrude from the stopper body toward the valve spring, and the valve spring may be seated on the spring support.

The stopper may further include a guide protrusion that protrudes from the spring support toward the valve spring and coupled to a spring recess part or recess of the valve spring. The recessed shape of the guide device may correspond to a deformed shape of the valve spring when the discharge valve is opened.

The linear compressor may further include a frame that fixes the cylinder to the shell; a discharge cover coupled to the frame, the discharge cover having a resonance chamber to reduce pulsation of the refrigerant discharged through the discharge valve; and a spacer disposed on the discharge cover to support the stopper. The resonance chamber may include a plurality of resonance chambers, the discharge cover may further include a seat part or seat that partitions the plurality of resonance chambers and supports the spacer, and each of the plurality of resonance chambers may be recessed from the seat part.

The valve spring may include a spring body having a plurality of cutoff parts or cutoffs, and an insertion hole defined in the spring body. The insertion hole may be coupled to an insertion protrusion of the discharge valve. The valve avoidance groove may be defined in or at a position corresponding to a portion of the insertion protrusion.

The linear compressor may further include a frame that fixes the cylinder to the shell; a discharge cover coupled to the frame, the discharge cover having a resonance chamber to reduce pulsation of the refrigerant discharged through the discharge valve; a first spacer disposed between the valve spring and the stopper to space the valve spring from the stopper; and a second spacer disposed on the cover body to support the support. The guide device may extend from an inner circumferential surface of the first spacer toward a central portion of the stopper.

The cylinder may include a nozzle part or nozzle to introduce the refrigerant discharged through the discharge valve into the cylinder and on which a filter member may be disposed.

Embodiments disclosed herein further provide a linear compressor that may include a shell in which a discharge port is provided; a cylinder disposed in the shell to define a compression space for a refrigerant; a frame that fixes the cylinder to the shell; a piston disposed to be reciprocated in an axial direction within the cylinder; a discharge valve disposed on or at one side of the cylinder to selectively discharge the refrigerant compressed in the compression space; a discharge cover coupled to the frame, the discharge cover having a resonance chamber to reduce pulsation of the refrigerant discharged through the discharge valve; a valve spring disposed on the discharge cover; and a stopper coupled to the valve spring, the stopper having one surface that is recessed in a direction in which the valve spring is deformed. The recessed surface of the stopper may include a rounded surface that contacts the valve spring. The recessed surface of the stopper may include an inclined surface that contacts the valve spring.

The discharge valve may include a valve body selectively and closely attached to the cylinder; a valve recess part or recess recessed from the valve body in one or a first direction to prevent the valve body from interfering with the discharge valve; and an insertion protrusion that protrudes from the valve body in the other or a second direction. The insertion protrusion may be coupled to the valve spring.

The valve spring may include a spring body having a plurality of cutoff parts or cutoffs; an insertion hole defined in a central portion of the spring body and into which an insertion protrusion of the discharge valve may be inserted; and a spring recess part or recess recessed from an outer circumferential surface of the spring body to guide a position of a guide protrusion of the stopper.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a shell in which a discharge port is provided;

a cylinder disposed in the shell to define a compression space for a refrigerant;

a piston disposed to be reciprocated in an axial direction within the cylinder;

a discharge valve disposed at one side of the cylinder to selectively discharge the refrigerant compressed in the compression space, the discharge valve including an insertion protrusion;

a plate spring coupled to the discharge valve to provide a restoring force, the plate spring including a spring body having a plurality of cutoffs and an insertion hole defined in the spring body to be coupled with the insertion protrusion; and a stopper coupled to the plate spring to restrict deformation of the plate spring, wherein the stopper comprises;

a stopper body having a contact surface that supports the plate spring when the plate spring is deformed;

a spring support that protrudes from a periphery of the stopper body to allow the stopper body to be spaced apart from the plate spring; and a valve avoidance groove defined in a central portion of the stopper body when the discharge valve is in its open position such that the stopper does not interfere with the insertion protrusion, wherein the contact surface extends between the spring support and the valve avoidance groove, and comprises a rounded surface or a slanted surface that extends at an incline with respect to a radial direction substantially perpendicular to the axial direction.

2. The linear compressor according to claim 1, wherein the spring support protrudes from the stopper body toward the plate spring with respect to the contact surface, and wherein the plate spring is seated on the spring support.

3. The linear compressor according to claim 2, wherein the stopper further comprises a guide protrusion that protrudes from the spring support toward the plate spring and is coupled to a spring recess of the plate spring.

4. The linear compressor according to claim 1, further comprising:

a frame that fixes the cylinder to the shell;

a discharge cover coupled to the frame, wherein the discharge cover has at least one resonance chamber to reduce pulsation of the refrigerant discharged through the discharge valve; and a spacer disposed on the discharge cover to support the stopper.

5. The linear compressor according to claim 4, wherein the at least one resonance chamber comprises a plurality of resonance chambers, wherein the discharge cover further comprises a seat that partitions the plurality of resonance chambers and supports the spacer, and wherein each of the plurality of resonance chambers is recessed from the seat.

6. The linear compressor according to claim 1, wherein a recessed shape of the contact surface corresponds to a deformed shape of the plat spring when the discharge valve is opened.

7. The linear compressor according to claim 1, further comprising:

a frame that fixes the cylinder to the shell;

a discharge cover coupled to the frame, wherein the discharge cover has at least one resonance chamber to reduce pulsation of the refrigerant discharged through the discharge valve;

a first spacer disposed between the plate spring and the stopper to space the plate spring from the stopper; and a second spacer disposed on the cover body to support the stopper.

8. The linear compressor according to claim 7, wherein the contact surface extends from an inner circumferential surface of the first spacer toward a central portion of the stopper.

9. The linear compressor according to claim 1, wherein the cylinder comprises at least one nozzle to introduce the refrigerant discharged through the discharge valve to an inside of the cylinder and in which a filter member is disposed.

* * * * *